US006933902B2

(12) United States Patent
Yeh

(10) Patent No.: US 6,933,902 B2
(45) Date of Patent: Aug. 23, 2005

(54) DUAL-FREQUENCY ANTENNA

(75) Inventor: Ming-Hau Yeh, Hsinchu (TW)

(73) Assignee: Alpha Networks Inc., Hsinchu (TW)

( * ) Notice: Subject to any disclaimer, the term of this patent is extended or adjusted under 35 U.S.C. 154(b) by 8 days.

(21) Appl. No.: 10/760,369

(22) Filed: Jan. 21, 2004

(65) Prior Publication Data

US 2005/0156795 A1 Jul. 21, 2005

(51) Int. Cl.[7] ..... H01Q 3/00
(52) U.S. Cl. ..... 343/762; 343/700 MS
(58) Field of Search ..... 343/700 MS, 702, 343/762, 846

(56) References Cited

U.S. PATENT DOCUMENTS 6,046,703 A * 4/2000 Wang et al. ..... 343/795
6,133,880 A * 10/2000 Grangeat et al. .... 343/700 MS
6,650,294 B2 * 11/2003 Ying et al. ..... 343/700 MS

* cited by examiner

*Primary Examiner*—Tuyet Vo
*Assistant Examiner*—Jimmy Vu
(74) *Attorney, Agent, or Firm*—Bacon & Thomas PLLC

(57) ABSTRACT

The present invention discloses a dual-frequency antenna, wherein a coplanar wave guide wire is printed onto a dielectric substrate, so that an end of the coplanar wave guide wire can be used as a signal input end, and a ground metal surface is printed onto the same side of the dielectric substrate at a position corresponding to the periphery of the coplanar wave guide wire. The ground metal surface keeps a certain distance from the coplanar wave guide wire, and the other end of the coplanar wave guide wire is extended outside the ground metal surface. A radiating member is extended from a side along the direction of the longitudinal axis, and a meandered conductive wire is extended from the other side at the end of the longitudinal axis. The radiating member is parallel to the conductive wire, and a gap is kept in parallel to the edge of the ground metal surface, so that each radiating member can be used to receive signals of different frequencies.

11 Claims, 4 Drawing Sheets

DUAL-FREQUENCY ANTENNA

BACKGROUND OF THE INVENTION

1. Field of the Invention

The present invention relates to antennas, more particularly to a dual-frequency antenna for mobile phones.

2. Description of the Related Art

At the beginning of 1980's, European countries jointly established a Group Special Mobile (GSM) research team to conduct research and development for setting up a GSM system standard in order to solve the incompatibility of mobile phone systems in Europe, and the issue of mobile phone users unable to roam around Europe. The GSM research team set up two frequencies within the 900 MHz range for being used by digital mobile phones. Since GSM systems adopt a "digital technology", therefore, it does not only improve the system capacity, but also effectively solves the problems of not having sufficient capacity for analog systems, communication confidentiality, and data communication capability. The GSM system further solves the issue of incompatibility of mobile phones in different countries. Therefore, the range of GSM applications has grown rapidly since 1992 when it officially started providing services. The GSM system has become one of the most fast-growing types of digital mobile phones, which can be illustrated by the number of existing mobile phone owners. Almost everyone has a mobile phone in these days.

Further, the General Packet Radio Service (GPRS) communication protocol was established to meet the user's requirements for the wireless communications. In fact, the GPRS uses the current GSM communication network architecture to provide a high-speed packet data radio service without replacing all of the current GSM systems, so that users can connect to a wireless network to transmit and receive text and graphic data. The GPRS has a transmission speed of up to 115K per second, and can maintain an online connection nearly all the time. Therefore, more and more people select the mobile phone having the functions of the GPRS system in recent years to transmit and receive data via wireless networking.

In general, a traditional antenna used in GSM mobile phones is limited to a single-frequency antenna. However, the single frequency antenna no longer meets the requirements of the fast development of the diversified communication system. Therefore, the single-frequency antenna is gradually substituted by the dual-frequency antenna that can support dual-frequency systems. The dual-frequency antenna at early stage adopts the exposed design. However, since this kind of antenna is exposed outside the casing of the mobile phone, the mobile phone cannot have a compact design, not only causing inconvenience to the users, but also creating bottlenecks and obstacles on the styling design. Therefore, the dual-frequency antenna used in a dual-frequency mobile phone 10 gradually changes to the built-in dual-frequency antenna 12 as shown in FIG. 1. Although the antenna of such dual-frequency mobile phone 10 is hidden, which can give a better look for the overall design, the dual-frequency antenna 12 is added to the printed circuit board 11 of the mobile phone 10, not only making the assembly inconvenient, but also having the disadvantages of occupying extra space and costing more. Furthermore, the size of mobile phones 10 cannot meet the requirements and trend of a compact design.

SUMMARY OF THE INVENTION

The primary objective of the present invention is to print a coplanar wave guide wire onto one side of a dielectric substrate, so that one end of the coplanar wave guide wire can be used as a signal input end, and to print a ground metal surface onto the same side of the dielectric substrate at a position corresponding to the periphery of the coplanar wave guide wire, and the ground metal surface keeps a certain distance from the coplanar wave guide wire, and the other end of the coplanar wave guide wire is extended outside the ground metal surface. A radiating member is extended from one side along the direction of the longitudinal axis, and a meandered conductive wire is extended from the other side at the end of the longitudinal axis. The radiating member is parallel to the conductive wire, and a gap is kept in parallel to the edge of the ground metal surface, so that each radiating member can be used to receive signals of different frequencies. Another objective of the present invention is to directly print the dual-frequency antenna onto a printed circuit board, particularly onto an unused space of the printed circuit board, for receiving signals of different frequencies. The dual-frequency antenna is integrated with the circuit of the printed circuit board to effectively reduce the assembling time and cost.

A further objective of the present invention is to directly print a part of the circuit of the dual-frequency antenna onto the printed circuit board, and the rest of the circuit of the dual-frequency antenna is built onto a dielectric substrate. The dielectric substrate is fixed onto the edge of the printed circuit board, so that one end of the coplanar wave guide wire disposed on the printed circuit board can be used as a signal input end of the dual-frequency antenna, and the dual-frequency antenna is thus integrated indirectly with the circuit on the printed circuit board.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
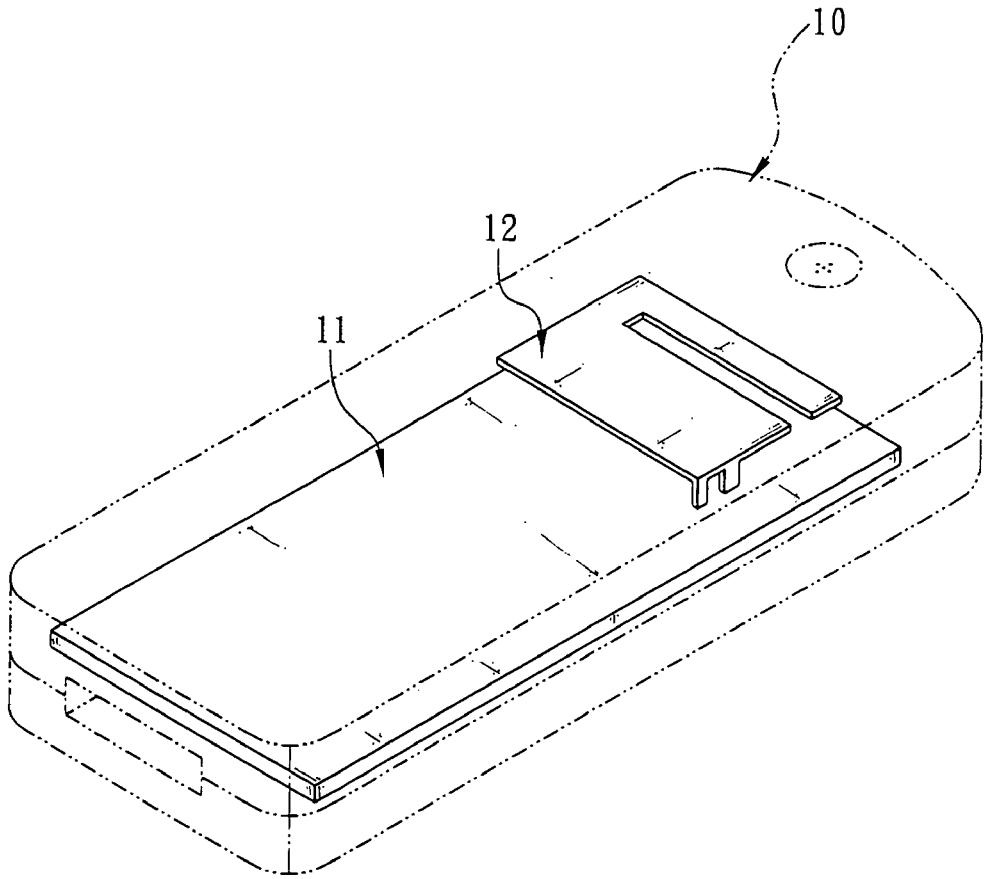
FIG. 1 (Prior Art)
FIG. 1 is a view of a prior-art dual-frequency mobile phone having a built-in dual-frequency antenna.
Figure 2:
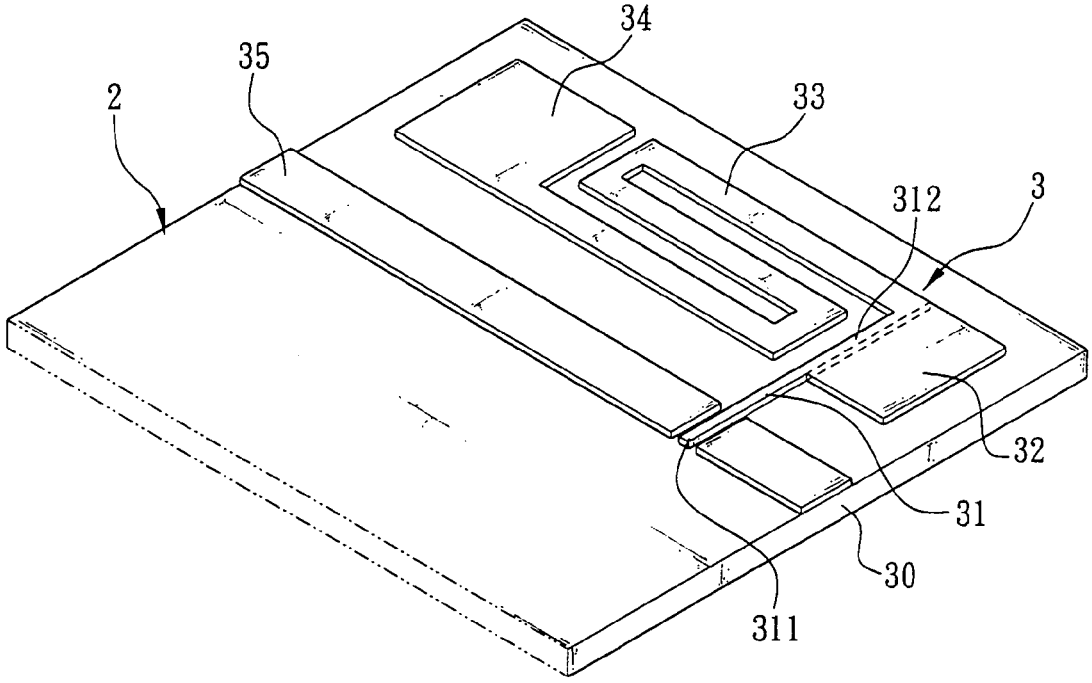
FIG. 2 is a view of a preferred embodiment of the present invention.
Figure 3:
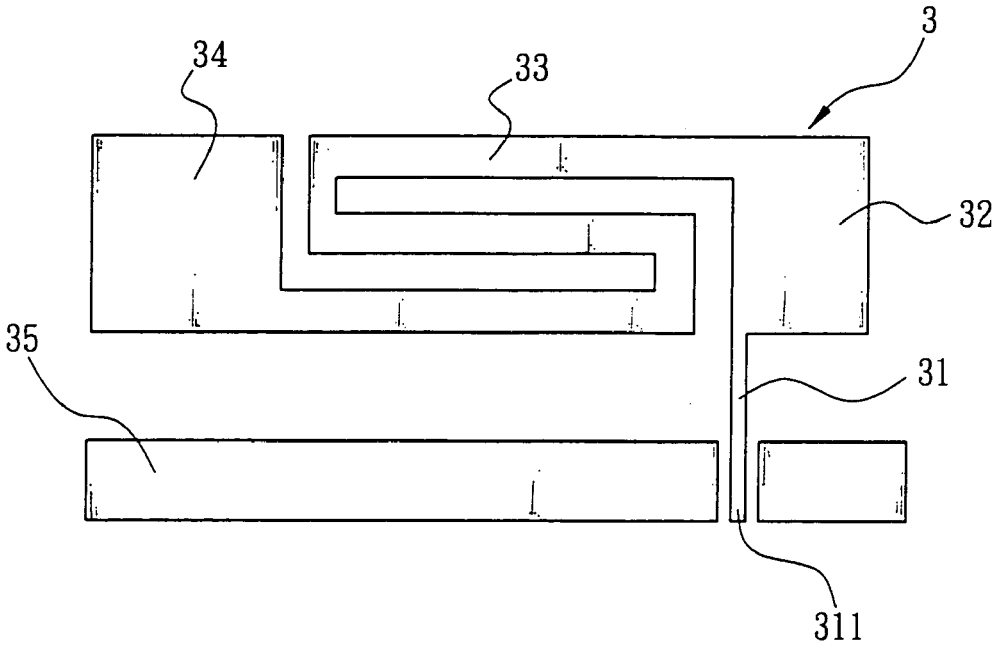
FIG. 3 is a planar view of the dual-frequency antenna as shown in FIG. 2.

Please refer to FIGS. 2 and 3 for a preferred embodiment of the present invention, which uses a coplanar wave guide as an input line, and directly print a dual-frequency antenna onto a printed circuit board 2 (such as a printed circuit board of GSM and GPRS dual-frequency mobile phone). Such coplanar wave guide dual-frequency antenna 3 comprises a dielectric substrate 30; a coplanar wave guide wire 31 printed onto one side of the dielectric substrate 30, and one end of the coplanar wave guide wire 31 being used as a signal input end 311; a ground metal surface 35 printed on the same side of the coplanar wave guide wire 31 at a position corresponding to the periphery of the coplanar wave guide wire 31, and the ground metal surface 35 keeping a certain distance from the coplanar wave guide wire 31, and the other end of the coplanar wave guide wire 31 being extended outside the ground metal surface 35; a radiating member 32 being extended from one side along the direction of the longitudinal axis; a meandered conductive wire 33 extended from another side at the end of the longitudinal axis 312; a radiating member 34 being extended from an end of the meandered conductive wire 33. The two radiating members 32, 34 are separated on two sides and parallel to each other. The ground metal surface 35 keeps a gap in parallel, so that each radiating member 32, 34 can receive a first operating signal and a second operating signal of different frequencies.

Figure 5:
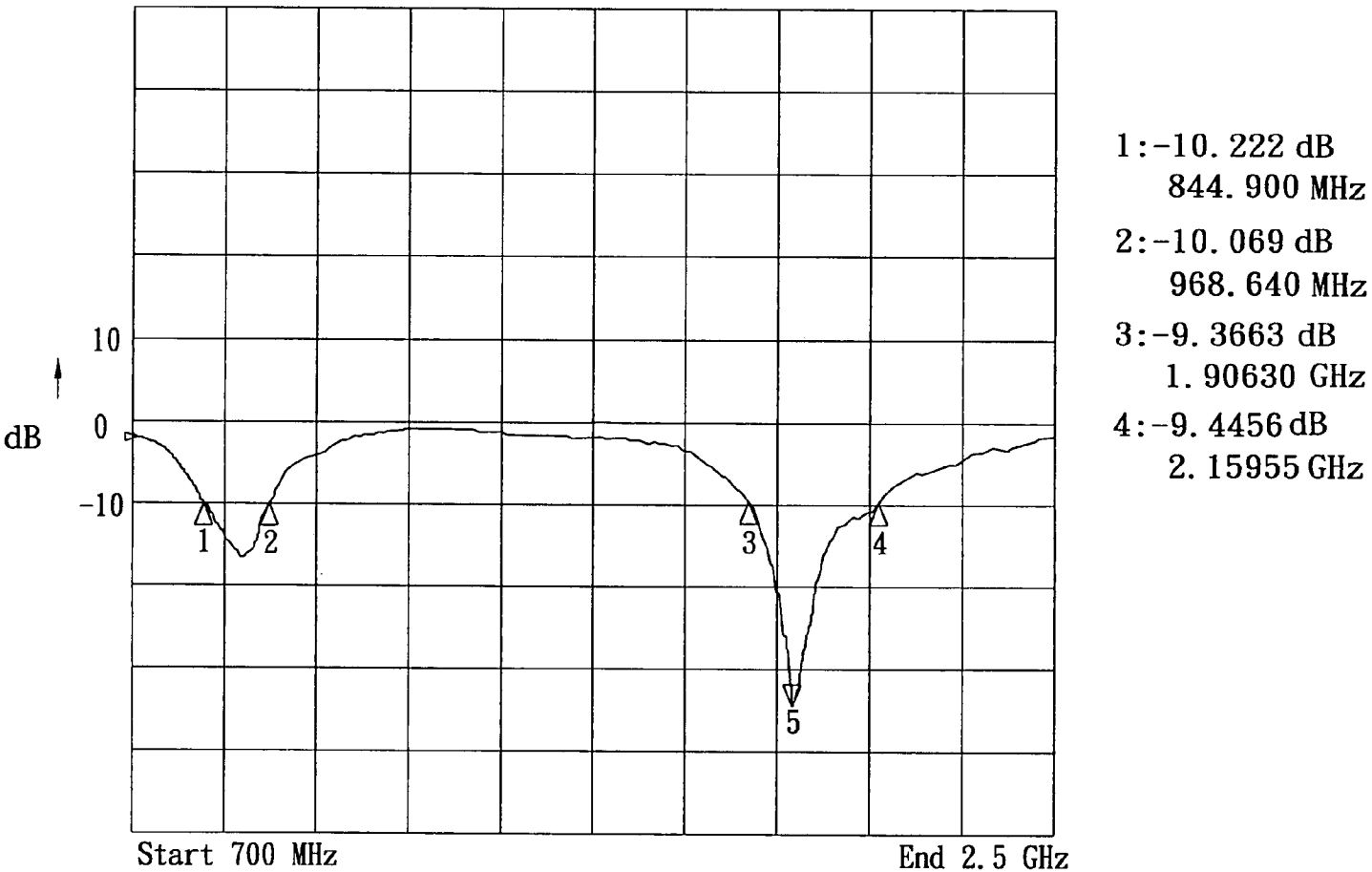
FIG. 5 is a chart showing the actual measured of the dual-frequency antenna as shown in FIG. 2.

In view of the description above, the present invention makes use of the unused space on the printed circuit board 2 to print the coplanar wave guide wire 31, two radiating members 32, 34, meandered conductive wire 33, and ground metal surface 35 directly onto a printed circuit board 2 having a thickness of 0.8 mm and a dielectric coefficient of 4.3~4.7 according to the antenna structure as shown in FIG. 2 and produce the dual-frequency antenna in accordance with the present invention. Please refer to FIG. 3. The coplanar wave guide wire 31 has a width of 1 mm. The radiating member 32 has a width of 16 mm and a length of 8.5 mm. The other radiating member 34 has a width of 6 mm and a length of 8.5 mm. The two radiating members 32, 34 are separated by the meandered conductive wire 33 on both sides, and their distance apart is 26 mm. The meandered conductive wire 33 has a width of 1.5 mm, and separated with each other with a gap of 1.5 mm. The two radiating members 32, 34 keep a parallel gap of 6 mm from the ground metal surface 35. At that time, the antenna is operated within two frequencies, say 844.900–968.640 MHz (MIL) and 1.90630 GHz~2.15955 GHz, and the measured results of their return loss are shown in FIG. 5. Both frequencies are better than 9 dB. The measured result indicates that the dual-frequency of the present invention can receive the dual frequency signals as specified by the GSM and GPRS protocols.

Figure 4:
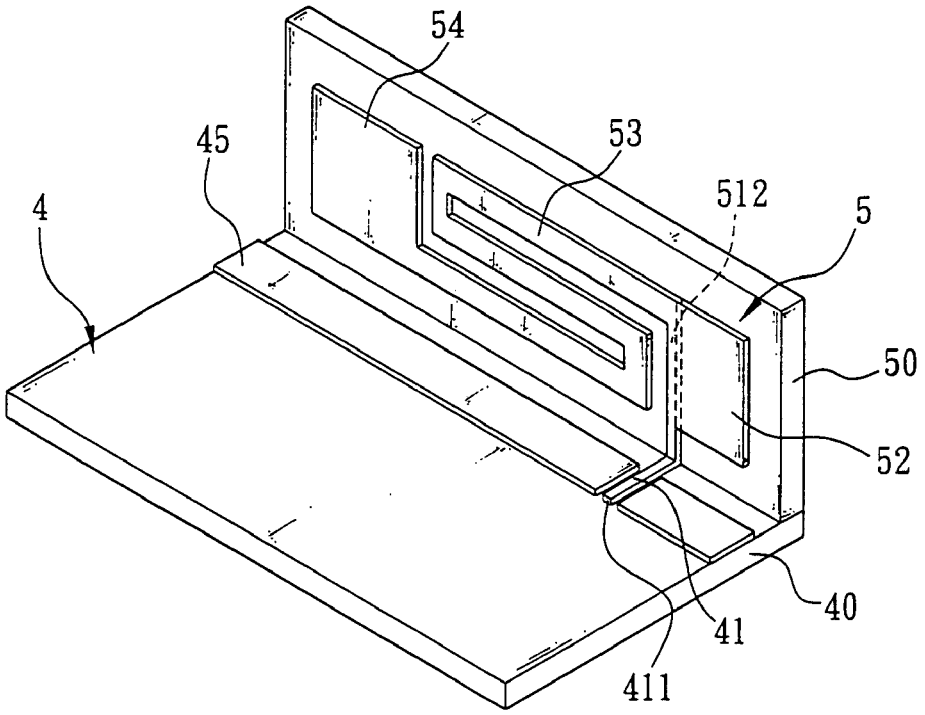
FIG. 4 is a view of another preferred embodiment of the present invention.

Please refer to FIG. 4 for another preferred embodiment. A coplanar wave guide wire 41 is printed on a side of a dielectric substrate 40 in a printed circuit board 4, and a ground metal surface 45 is printed onto the same side of the coplanar wave guide wire at a position corresponding to the coplanar wave guide wire 41. The metal ground surface 45 keeps a certain distance from the coplanar wave guide wire 41. The other end of the coplanar wave guide wire 41 is extended outside the ground metal surface 45 to the edge of the printed circuit board 4. In such preferred embodiment, a dual-frequency antenna 5 is fixed horizontally or vertically onto the edge of the printed circuit board 4. The antenna of the preferred embodiment shown in FIG. 4 is fixed vertically. The dual-frequency antenna 5 comprises another dielectric substrate 50. A conductive wire 512 is printed onto one side of another dielectric substrate 50, and one end of the conductive wire 512 is coupled to another end of the coplanar wave guide wire 41, so that one end of the coplanar wave guide wire 41 can be used as a signal input end 411 for the dual-frequency antenna 5. Another end of the conductive wire 512 is extended vertically onto the ground metal surface 45. A radiating member 52 is extended from one side of the longitudinal axis of the conductive wire 512, and a meandered conductive wire 53 is extended from one side at the end of the conductive wire 512. Another radiating member 54 is extended from the end of the meandered conductive wire 53. The two radiating members 52, 54 are separated by the meandered conductive wire 53 to both sides; they are not only parallel to each other, but also keeps a parallel gap with the ground metal surface 45, so that each radiating member 52, 54 can receive signal with different frequencies of the first operating frequency and the second operating frequency.

The antenna structure of the present invention as shown in FIG. 4 is to directly build the coplanar wave guide wire 41 and the ground metal surface 45 onto the unused space of the printed circuit board 4 having a thickness of about 0.8 mm and a dielectric coefficient of about 4.3~4.7, and then build the two radiating members 52, 54 and the meandered conductive wire 53 on another dielectric substrate 50 to produce the dual-frequency antenna 5 in accordance with this invention. The antenna 5 is fixed onto the edge of the printed circuit board 4, such that one end of the conductive wire 512 is coupled to another end of the coplanar wave guide wire 41, and one end of the coplanar wave guide wire 41 can be used as a signal input end 411 of the dual-frequency antenna 5. In such preferred embodiment, the coplanar wave guide wire 41 has a width of 1 mm; the radiating member 52 has a width of 16 mm and a length of 8.5 mm; another radiating member 54 has a width of 6 mm and a length of 8.5 mm. The two radiating members 52, 54 are separated by the meandered conductive wire 53 to both sides and having a gap of 23 mm. The meandered conductive wire 53 has a width of 1.5 mm and 1.5 mm apart from each other. The two radiating members 52, 54 keeps a parallel gap of 6 mm with the ground metal surface 45, so that the antenna can be operated in the two frequencies within 844.900~968.640 MHz and 1.90630 GHz~2.15955 GHz, and the measured results of their return loss are shown in FIG. 5. Both frequencies are better than 9 dB. The measured result indicates that the dual-frequency of the present invention can receive the dual frequency signals as specified by the GSM and GPRS protocols.

In view of the description above, the present invention not only builds the dual-frequency antenna directly on the printed circuit board of the GSM and GPRS dual-frequency mobile and makes use of the unused space on the printed circuit board to make a dual-frequency antenna for receiving different frequencies of the GSM and GPRS signals, but also selects to print part of the circuit of the dual-frequency antenna directly on the circuit board of the GSM and GPRS dual-frequency mobile phone, and builds the rest of the circuit on another dielectric substrate, so that when another substrate is fixed onto the edge of the printed circuit board, one end of the coplanar wave guide wire disposed on the printed circuit board can be used as a signal input end. Therefore, the dual-frequency antenna can be integrated directly or indirectly with the printed circuit board, and also effectively reduce the assembling time and cost of the dual-frequency mobile phones.

While the present invention has been described by the most practical and preferred embodiments, it is understood that this invention is not limited to the disclosed embodiments but is intended to cover various arrangements included within the spirit and scope of the broadest interpretations and equivalent arrangements.

What is claimed is:

1. A dual-frequency antenna, directly printed onto a printed circuit board, comprising:

a dielectric substrate;

a coplanar wave guide wire, printed on a side of said dielectric substrate and using one end as a signal input end;

a ground metal surface; printed onto a surface on the same side of said coplanar wave guide wire and at a position corresponding to the periphery of said coplanar wave guide wire, and said ground metal surface keeping a specific distance from said coplanar wave guide wire; wherein another end of said coplanar wave guide wire being extended outside said ground metal surface and having a radiating member extended out from a side along the direction of its longitudinal axis for receiving a first operating frequency and a meandered conductive wire extended out from another side at the end of said longitudinal axis; and another radiating member being extended out from the end of said meandered conductive wire for receiving a second operating frequency.

2. The dual-frequency antenna of claim 1, wherein said two radiating members are separated on two sides by said meandered conductive wire.

3. The dual-frequency antenna of claim 2, wherein said two radiating members are separated and parallel to each other.

4. The dual-frequency antenna of claim 3, wherein said two radiating members are separated and parallel to said ground metal surface.

5. A dual-frequency antenna, fixed on an edge of a printed circuit board, comprising:

a coplanar wave guide wire, printed on a side of a first dielectric substrate and using one end as a signal input end;

a ground metal surface; printed onto a surface on the same side of said coplanar wave guide wire and at a position corresponding to the periphery of said coplanar wave guide wire, and said ground metal surface keeping a specific distance from said coplanar wave guide wire;

a second dielectric substrate, fixed on a side of said printed circuit board, having a conductive wire printed onto one side, and one end of said conductive wire being coupled to another end of said coplanar wave guide wire, another end of said conductive wire extending along the direction perpendicular to said ground metal surface, a radiating member extended out from the direction of the longitudinal axis of said conductive wire, a meandered conductive wire extended out from another side at an end of said conductive wire, and another radiating member extended from an end of said meandered conductive wire.

6. The dual-frequency antenna of claim 5, wherein said two radiating members are separated on two sides by said meandered conductive wire.

7. The dual-frequency antenna of claim 6, wherein said two radiating members are separated and parallel to each other.

8. The dual-frequency antenna of claim 7, wherein said two radiating members are separated and parallel to said ground metal surface.

9. The dual-frequency antenna of claim 8, wherein said second dielectric substrate is fixed onto an edge of said printed circuit board.

10. The dual-frequency antenna of claim 8, wherein said second dielectric substrate is fixed vertically onto an edge of said printed circuit board.

11. The dual-frequency antenna of claim 8, wherein said first and second operating frequencies are different frequencies.

* * * * *